US006928906B1

(12) United States Patent
Marks

(10) Patent No.: US 6,928,906 B1
(45) Date of Patent: Aug. 16, 2005

(54) LARGE SELF-FORMING SOCKET

(75) Inventor: Joel S. Marks, Sherman Oaks, CA (US)

(73) Assignee: WorkTools, Inc., Chatsworth, CA (US)

( * ) Notice: Subject to any disclaimer, the term of this patent is extended or adjusted under 35 U.S.C. 154(b) by 15 days.

(21) Appl. No.: 10/930,919

(22) Filed: Aug. 31, 2004

(51) Int. Cl.[7] ..... B25B 13/58

(52) U.S. Cl. ..... 81/185; 81/124.5; 81/442; 81/DIG. 11

(58) Field of Search ..... 81/185, DIG. 11, 81/124.4, 124.5, 124.6, 179, 442, 448, 437, 81/461; 269/266

(56) References Cited

U.S. PATENT DOCUMENTS

| | | | | |
|---|---|---|---|---|
| 1,529,605 | A | 3/1925 | Muncey | |
| 2,711,112 | A | 6/1955 | Durand | |
| 2,754,708 | A | 7/1956 | Peterson | |
| 3,349,655 | A | 10/1967 | Locke | |
| 3,698,267 | A | 10/1972 | Denney | |
| 3,858,468 | A | 1/1975 | Pasbrig | |
| 4,887,498 | A | 12/1989 | Zayat | |
| 4,993,289 | A * | 2/1991 | Parks | 81/124.6 |
| 5,157,995 | A | 10/1992 | Nogues | |
| 5,460,064 | A | 10/1995 | Zayat, Jr. | |
| 5,551,320 | A * | 9/1996 | Horobec et al. | 81/53.2 |
| 5,622,090 | A | 4/1997 | Marks | |
| 5,676,028 | A * | 10/1997 | Jordan | 81/177.2 |
| 5,746,416 | A | 5/1998 | Paylor | |
| 5,791,209 | A | 8/1998 | Marks | |
| 5,794,644 | A | 8/1998 | Paylor | |
| 5,806,385 | A | 9/1998 | Schupp | |
| 5,829,328 | A * | 11/1998 | Chen | 81/185 |
| 5,937,715 | A | 8/1999 | Lin | |
| 6,023,999 | A | 2/2000 | Cho | |
| 6,089,130 | A * | 7/2000 | Wu | 81/177.1 |
| 6,138,534 | A * | 10/2000 | Cho | 81/185 |
| 6,182,538 | B1 * | 2/2001 | Chen | 81/177.1 |

* cited by examiner

*Primary Examiner*—Hadi Shakeri
(74) *Attorney, Agent, or Firm*—Paul Y. Feng; Fulwider Patton Lee & Utecht, LLP

(57) ABSTRACT

A heavy duty, large self-forming socket having a plurality of retractable gripping pins bundled in parallel and held in a frame within a housing is disclosed. The frame is positioned axially within the housing by radially extending, elongated hold elements that are positioned circumferentially around the housing. Slots in the housing exterior allow efficient inspection of the position of holes into which the hold elements are installed. A collar with shelf around the center pin protects the bias spring for the pin from over-compression. The gripping pins may be held to the frame by spring clips. An adaptor is attached wherein a secondary operation is used to remove the adaptor from the square end of the socket. The self-forming socket is well suited for use with valves and controls for water, gas, sewage conduits and piping.

14 Claims, 5 Drawing Sheets

30
75
20
24
27
32
31
31a 30
75
27
24
32
31
31a
27
20

40
47
43
240
145
48
144

240
47
40
43
48
144
145

70
20
144
240
27
40
43
26
43
144
240

LARGE SELF-FORMING SOCKET

BACKGROUND OF THE INVENTION

The present invention relates to tools used for industrial, public utility, and heavy duty applications. More precisely, the present invention relates to a large, self-forming socket tool for heavy duty use for the construction industry, steam, water and sewage piping, large conduits, earth moving equipment, and the like.

Many of today's machines are assembled using bolts, nuts, wing-nuts, screws, and similar fasteners. In order to work with such fasteners, wrenches and socket sets are common required tools. Unfortunately, there are a large variety of such fasteners. Even for a standard hex-head bolt, there are numerous English and metric sizes. For a craftsman to be fully prepared to work with such a myriad of bolts, he must maintain a large assortment of socket sizes, and sometimes that assortment must include different socket shapes. Having to locate the correct size socket-head and switching between different sized socket-heads to use in conjunction with a wrench or power tool are cumbersome and inconvenient tasks.

As a result, there have been developments into sockets that self-adjust to the particular size and shape of the bolt head or nut. For example, U.S. Pat. No. 3,858,468 to Pasbrig et al. discloses a clamping tool having a housing with a chamber therein and an opening at one end. A plurality of bundled, square shape bars are disposed in the chamber, wherein the bars are individually displaceable inward of the housing against the spring action of a pad. As the tool is pushed over the head of a bolt or a nut, the bars in contact retract into the pad and surrounding the nut or bolt head thereby gripping the part. The bolt head or nut can then be torqued as necessary.

U.S. Pat. No. 3,698,267 to Denney discloses a fastener actuator having a plurality of fastener engaging elements, wherein the elements are bundled and slide independently and longitudinally into and out of the actuator to accommodate a bolt head, nut, or slotted screw-head. Each element has a rectangular cross-section in order to grip the flat sides of a standard bolt head, or to fit into the flat walls of a slotted screw-head.

U.S. Pat. No. 4,887,498 to Zayat discloses a tool for form engaging and turning components such as nuts, bolts, and screws. In its basic form, the Zayat device includes a chamber which in turn supports a bundle of pins each of which is adapted to slide farther upwardly into the chamber when the lower pin end contacts the component at the lower end of the housing. Each of the pins has flat sides and sharp corners in order to engage a nut either by the flat sides or the sharp corners. U.S. Pat. No. 5,460,064 to Zayat shows in one embodiment headless dowels 52 to hold a frame, as seen in FIG. 6.

U.S. Pat. Nos. 5,791,209 and 5,622,090 to Marks show a universal socket tool. U.S. Pat. No. 5,937,715 to Lin teaches a socket tool with a two-piece threaded pin assembly. U.S. Pat. No. 5,806,385 to Schupp discloses a universal socket with a two-piece pin including a "pin retaining means 44." Based on the disclosure, the means are shown as rivet heads or pressed on collars. There is no provision for disassembly of the pins from the device. U.S. Pat. No. 6,023,999 to Cho shows a universal socket with pins press fitted into a block shaped frame.

U.S. Pat. No. 3,349,655 to Locke discloses an adjustable tool for installing or removing fasteners of various sizes, comprising of a bundle of rods surrounded by a girdle and resiliently mounted in a chuck. The rods may be pressed into conformity with the head of a fastener, and upon the application of torque to the chuck, the girdle constricts and accordingly torque is applied to the fastener through the rods. Each of the rods has flat sides and the bundle of rods are tightly packed.

U.S. Pat. No. 1,529,605 to Muncey discloses a wrench having closely packed and individually extendable rods that engage a bolt head or nut. Each of the extendable pins has a rectangular shaped cross-section.

The foregoing art teach of a method and structures for gripping a three dimensional object by using polygonal shaped pins closely packed in parallel in a bundle and independently displaceable longitudinally to accommodate the height dimension and contours of the device to be gripped. This construction has been used in a vise as well, as disclosed, for example, in U.S. Pat. No. 2,754,708 to Peterson. In Peterson '708, groove 60 is shown with a slip ring 62 fitted. The end of portion 58 is not tapered; therefore the split ring must only be installed from the side.

There have been other attempts at self-adjusting sockets. For instance, U.S. Pat. No. 5,157,995 to Nogues discloses a multiple socket wrench comprised of several coaxially disposed socket members housed within each other. The sockets are spring loaded and each has a reduced diameter towards the outer end that prevents the abutting sockets contained therein from falling off as a result of gravity or the spring force of the different spring members associated with each one of the sockets. Each spring urges each socket outwardly, and the springs of the sockets that are smaller than the head of the bolt or screw being matched are overcome and retracted, thereby automatically matching the correct size socket to the head of the bolt or nut. U.S. Pat. No. 2,711,112 to Durand discloses another multiple socket wrench having coaxially aligned sockets of varying sizes organized on the ratchet in a concentric arrangement.

For some applications it is required to have a very large size socket tool. One such application is for municipal water valves. These valves are actuated through a sometimes irregularly shaped square valve head that is 2 inches on each side. This use requires a socket that is about 3 inches between flats for a hexagonal interior socket. Another such application is for fire hydrants, which use an odd shaped valve head. Other chemical and industrial applications are also suited for a large universal socket tool. Such a large universal socket size leads to special needs that the forgoing devices cannot provide.

One such attempt at addressing such a need is disclosed in U.S. Pat. Nos. 5,746,416 and 5,794,644 to Paylor. The device is a slotted adapter at one end to register with a water main valve for turning the valve. A torquing handle may be attached to the adapter for applying torque from a location remote from the adapter. However, there is still a need for a socket tool that has sufficient strength and bulk to address the needs of such industrial applications unsuited for the conventional socket tool.

SUMMARY OF THE INVENTION

It is therefore an object of the present invention to provide a self-forming socket that form fits a variety of nuts and bolt heads of different shapes and sizes including large valve heads. It is a further object of the present invention to provide a large self-forming socket that may be efficiently manufactured including being readily assembled by automated methods. It is another object of the invention that the device may be disassembled by users for cleaning or repair.

In order to accomplish the foregoing objects, the present invention provides in one embodiment a self-forming socket comprising a frame having a plurality of openings there through, a plurality of pins closely packed in parallel, each pin having top and bottom ends and preferably a circular cross-sectional shape, wherein said bottom ends pass through respective openings in the frame and are slidably mounted thereto, a center pin slidably disposed in a central location on the frame, biasing members disposed on each pin urging the top end away from the frame, and a housing partially enclosing the frame, pins, and center pin wherein the top ends of the pins in their extended state are exposed through the housing.

In a preferred embodiment, the biasing member is a compression spring that returns the pin to an extended position away from the frame when the socket is disengaged from the fastener. The present invention in a preferred embodiment also includes an optional center pin slidably disposed at a central location on the frame. The center pin occupies an area at the center of the bundle of pins and helps center a fastener when the socket is first placed thereon. Advantageously, the center pin also reduces the number of individual pins required, thereby saving material costs.

In operation, a non-circular shaped head fastener or other object to be turned is pressed into the face of the present invention self-forming socket, thereby depressing the center pin into the housing along with a certain grouping of pins. The remaining pins surrounding the fasteners do not retract and are biased away from the frame and housing by coiled springs. Those extended pins surround the fastener and cause the fastener to be wedged inside the housing.

The present invention using circular cross-section pins provides a tight grip on a large variety of fasteners. In particular, the pins function entirely by wedging the fastener within the housing. The pins do not slide over each other because the tightly packed containment of the pins within the housing leaves the pins with no room to move out of place.

In the preferred embodiment, the frame is optionally made from an elastomeric or otherwise resilient material so that the enlarged ends of individual pins can be forced fit there through and slidably retained on the frame. Yet if removing a jammed fastener causes a pin to be forced back out through the frame, the pin and frame cannot be damaged, because the elastomeric frame gives way. Also, a pin that may be damaged in some way can easily be pulled out and replaced.

Likewise, the center pin is forced fit through the frame and is held in place by an oversized end. A damaged center pin can be forcibly separated from the frame by a tug for replacement when needed.

In various alternative embodiments, the pins could be designed to have a polygonal cross-section, such as a triangle, hexagon, or a combination round cornered and flat sided shape.

Preferably the interior walls of the socket include optional grooves forming a scalloped configuration. Each pin of the outer ring of pins fits into a groove so that the pins will not slide along the wall interior. This provides increased torque engagement.

These and other features and advantages of the invention will become apparent from the following detailed description when taken in conjunction with the accompanying exemplary drawings.

DETAILED DESCRIPTION OF THE PREFERRED EMBODIMENTS

The following specification describes a self-forming socket for heavy-duty, industrial applications. In the description, specific materials and configurations are set forth in order to provide a more complete understanding of the invention, but it is understood by those skilled in the art that the present invention can be practiced without those specific details. In some instances, well-known elements are not described precisely so as not to obscure the invention.

Figure 2:
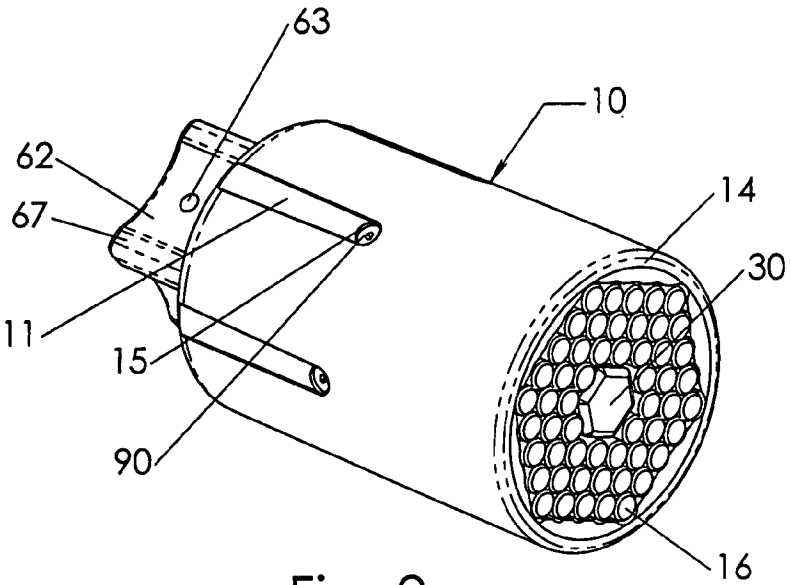
FIG. 2 is a front perspective view of the present invention self-forming socket wherein the pin top ends are visible.

The present invention is directed to a self-forming socket. As seen in FIG. 2, the socket in a preferred embodiment has a plurality of pins closely packed in parallel and slidably disposed on a mostly flat frame and enclosed within a housing with an open end. When the socket is fit onto a fastener such as a wing nut, bolt head, hex nut, etc., groups of the slidable pins are pushed into the housing to conform to the contours of the fastener. The axial shifting of the pins closely conforms the entire bundle to the specific contours of the fastener. When the socket is connected to a wrench, any torque on the wrench translates into a torque on the fastener via the bundled pins.

Figure 19:
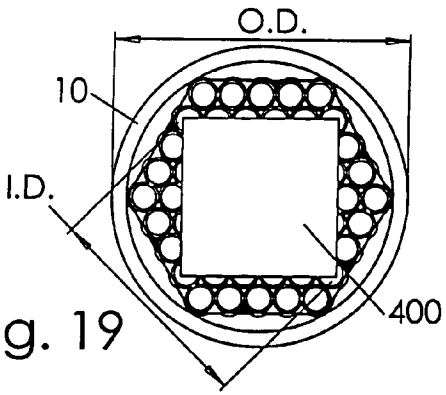
FIG. 19 is a plan view showing fitment of a socket over a square shaped head of a gas or water main valve.

FIG. 19 is a plan view of one embodiment of the present invention showing fitment of pins 40 over a square-shaped gas, water, or sewage main valve 400. For such uses, the outside diameter (O.D.) of housing 10 is preferably less than or equal to about 4 inches, including an O.D. from 1, 2, 3, up to and including about 4 inches and all sizes therebetween. Further, the inside diameter (I.D.) as measured diagonally corner-to-corner of the valve 400 is preferably about 2–3 inches, including all dimensions therebetween, and more preferably about 2.78 inches. Moreover, in view of the dimensions given above, in the exemplary embodiment, there is approximately at least one row of pins between valve 400 and the inside wall of housing 10 circumscribing valve 400, although this may not be true at the corners of valve 400, as seen in FIG. 19.

Typically, conduits, piping, ducts, carrying gas, water, sewage or the like are buried underground. The main lines with their valves for such piping are likewise buried. The dimensions given above for the present invention socket tool are advantageous since the O.D. of the tool is small enough to pass through a hole in the pavement giving access to the underground valve, yet there is sufficient girth and strength to the socket tool to torque the valve. A valve that is damaged, perhaps with its corners rounded or stripped away, or that is jammed, even if located in a tight space can still be accessed and torqued with the present invention socket tool.

Figures 11, 12, 13, 14, 15:
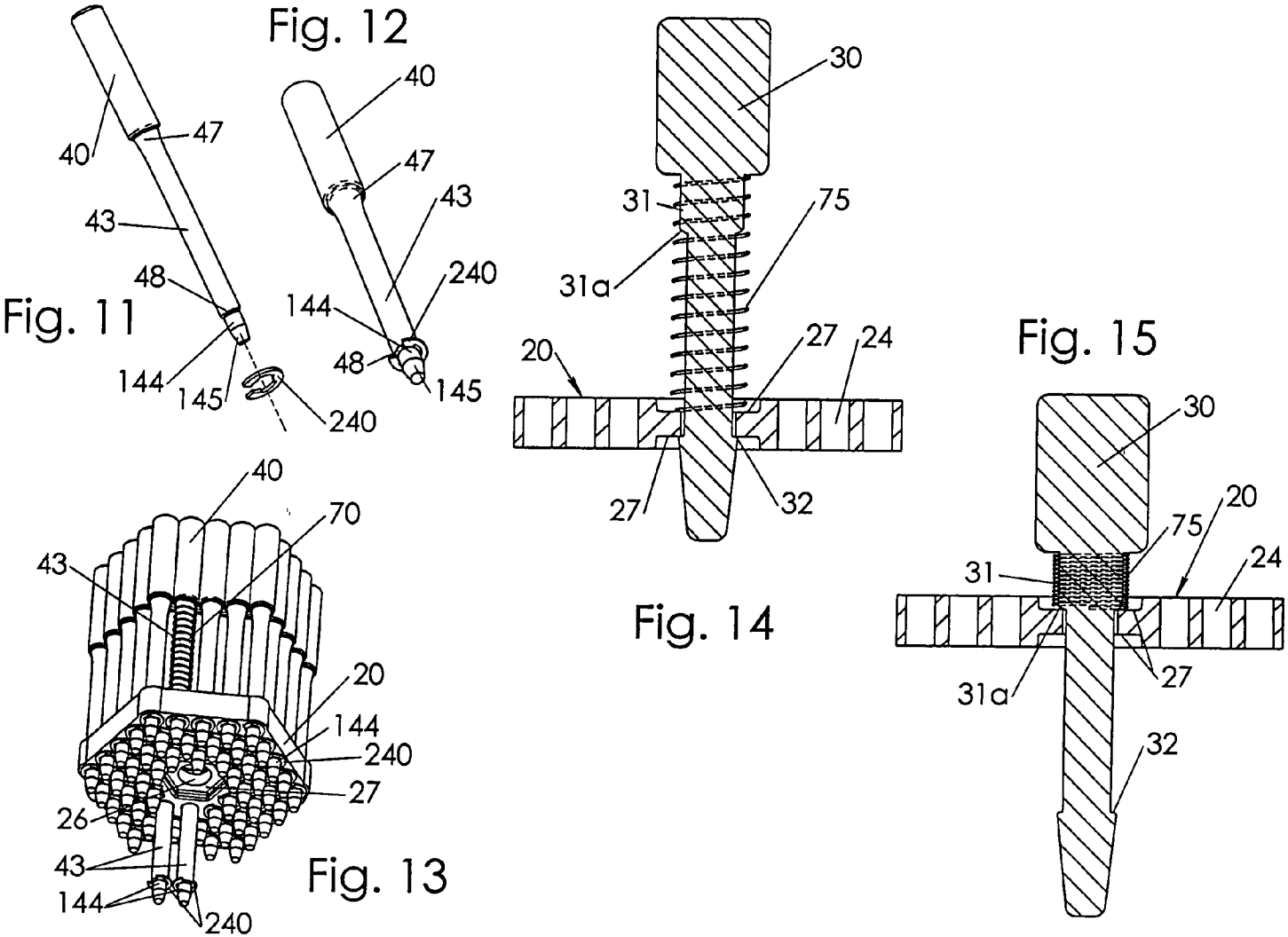
FIG. 11 is an exploded view of a pin and spring clip assembly.
FIG. 12 is a perspective view of the pin of FIG. 11, with the clip assembled.
FIG. 13 is a bottom perspective view of a pin/frame subassembly.
FIG. 14 is a sectional view of a center-pin/frame subassembly, with the center-pin extended.
FIG. 15 is the sectional view of FIG. 14, with the center-pin retracted.

When the socket tool is pressed against a fastener or valve stem during use, a group of pins 40 is forced toward the frame 20 and into the back of the housing 10. This action compresses the coiled spring 70. FIG. 13 shows two pins 40 in this retracted position, where shaft 43 forms a bottom end of pin 40 and is visible under frame 20. Normally a larger group of pins is retracted as they conform over a fastener. Once the socket is removed from the fastener, the compressed coiled springs 70 urge the group of pins 40 back to their initially extended position where their respective enlarged tips 44, FIG. 4, stop at a bottom face of frame 20. Preferably, coiled spring 70 remains under load (i.e., biased toward expansion) in its initially extended position. Pins 40 may be referred to as gripping pins to contrast with the optional center pin 30.

Figure 1:
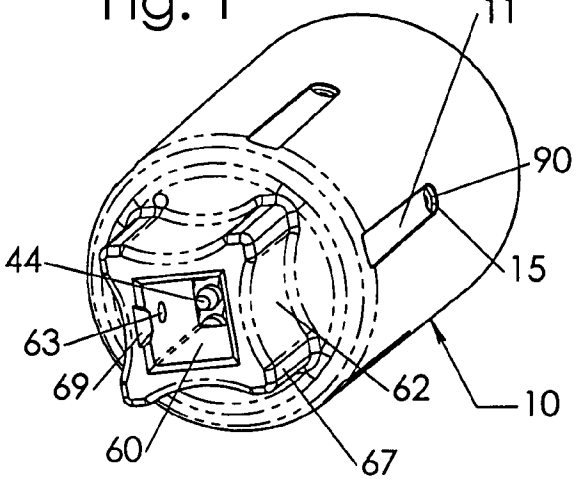
FIG. 1 is a rear perspective view of a preferred embodiment of the present invention self-forming socket.

FIG. 1 is a rear perspective view of a preferred embodiment of the present invention self-forming socket. The socket is comprised of a housing 10, including internal square end 60. Square end 60 extends rearward from the rear of the housing 10 and preferably includes an exterior with protruding thick corners 67 and with indented, thinner walls 62 connecting the corners. Thin wall section 62 may be of arcuate concave shape as shown, or stepped or other angular shape. In the large socket of the present invention the varying thickness walls of square end 60 allow reduced weight and material usage for housing 10, while preserving strength where required at the corners for heavy duty applications.

Ramp 69 seen in FIG. 1 is axially aligned with detent hole 63. In the cross-sectional view of FIG. 16, adaptor 300 includes square extension 303 at a distal end. Detent bar 305 is fitted into square end 303 of adaptor 300, and protrudes into detent hole 63. Ramp 69 urges detent bar 305 into square end 60 as adaptor 300 is pushed into position. Since detent hole 63 is axially aligned with ramp 69, it is readily apparent to a user installing an adaptor how to orient detent bar 305. Ramp 69 functions as an indicator to show the wall in which detent hole 63 is located of the four walls of square end 60. Adaptor 300 can be quickly oriented and secured to square end 60. Detent holes 63 could be provided in two or more walls of square end 63. A ramp 69 would be aligned with any such hole. However, it is less costly to use only one, or at most, two holes 63, where with two holes the second hole would be opposite the first hole. In this instance, a single drilling operation can make the first or second holes without repositioning housing 10. Adding a third or forth hole, however, requires repositioning housing 10 for drilling the extra holes perpendicular to the first two holes. The interior of housing 10 includes a terminating end 12 defining a space 12*a* partially enclosed by interior walls of housing 10, a bottom face of frame 20, pin bottom ends, and terminating end 12. Square end 60 extends downward, or rearward, from terminating end 12. Space 12*a* is therefore open through square end 60.

Figure 5:
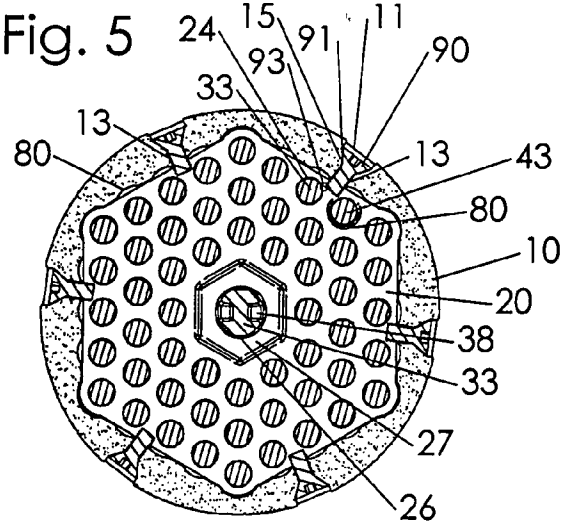
FIG. 5 is a sectional view of the socket of FIG. 3, taken across a diameter of the socket.
Figure 3:
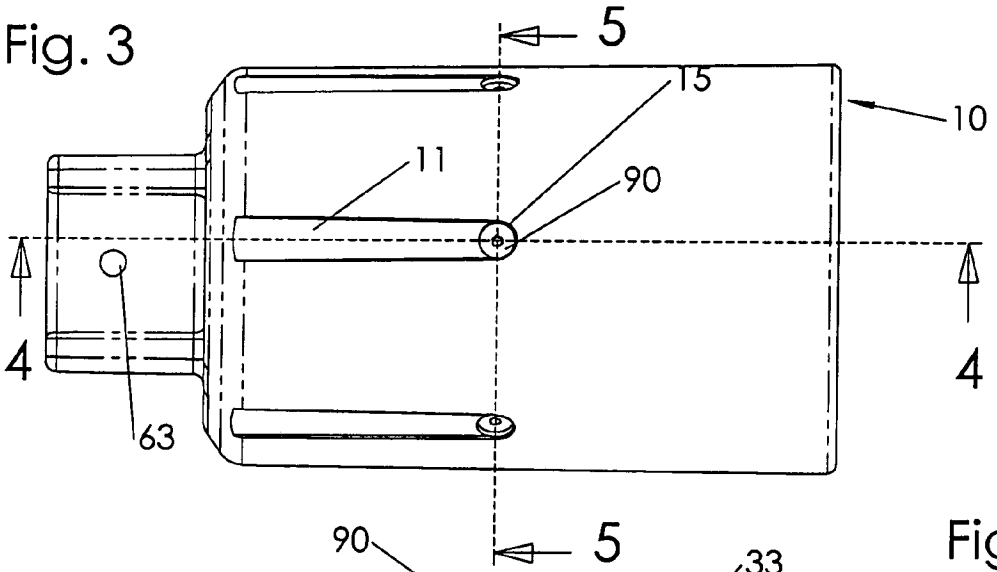
FIG. 3 is a side elevational view of the socket.
Figure 7:
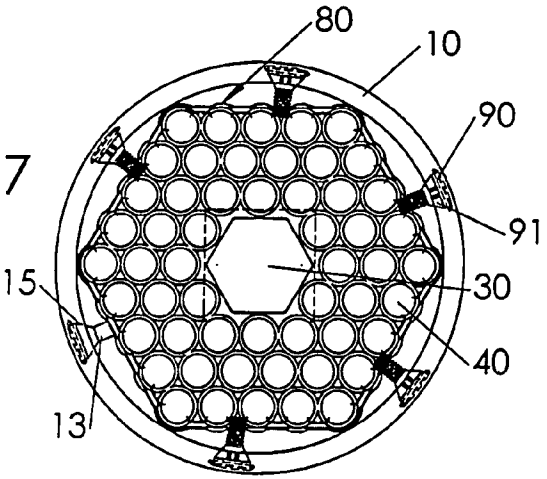
FIG. 7 is a front, end view of the socket, with hold elements and stops shown hidden, and with one hold element absent.

Slot 11, shown in FIGS. 1, 2 and 5, provides a reference for aligning holes 13, shown in FIG. 7, relative to the pins within housing 10. Housing 10 is formed by forging, casting or other process. Holes 13 are cross-drilled to extend inward from the exterior of housing 10. Slots 11 are formed during the process of making housing 10 and are accurately positioned along the circumference relative to the interior walls of housing 10. Slots 11 may be indented as shown or they may be protruding ridges or other contour or marking formed as part of the manufacture of housing 10. Such markings are equivalent to slots in the present disclosure.

Holes 13 are correlated to slots 11 so that the position of holes 13 can be easily inspected for the correct circumferential alignment. In the illustrated embodiment holes 13 are at the end of slots 11 and tangent to the edges of slots 11. As best seen in FIG. 5, it is preferred that holes 13 be centrally located between two pin shafts 43, and openings 24 of frame 20. This ensures that elongated hold elements 90 will clear or avoid contact with pins 40 as hold elements 90 extend inward toward the central position between adjacent shafts 43.

As seen in FIG. 2, an outer most ring of pins may include six lines of tangentially adjacent pins for the hexagonal configuration shown. A rectangular configuration would have four lines of pins in an outer ring, for example. Therefore, as seen in FIG. 5, pin shafts 43 are near to each other.

Figure 10:
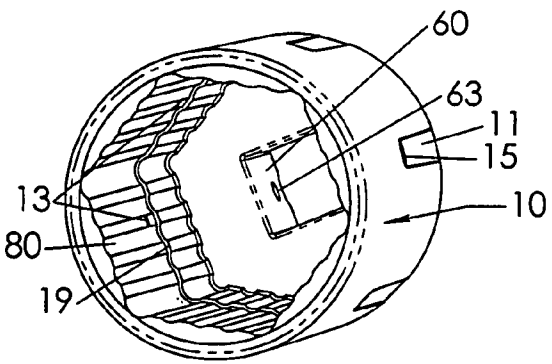
FIG. 10 is a front perspective view of a socket housing, without internal components.

In FIG. 10 showing an empty housing 10, holes 13 can be seen in the flat portion of the interior wall of housing 10, between two grooves 80. Whether there are any grooves 80 or slots 11, it is preferred that holes 13 and therefore hold elements 90 have a circumferential position centrally located or aligned between two pin shafts of the outer most ring of pins.

Figure 4:
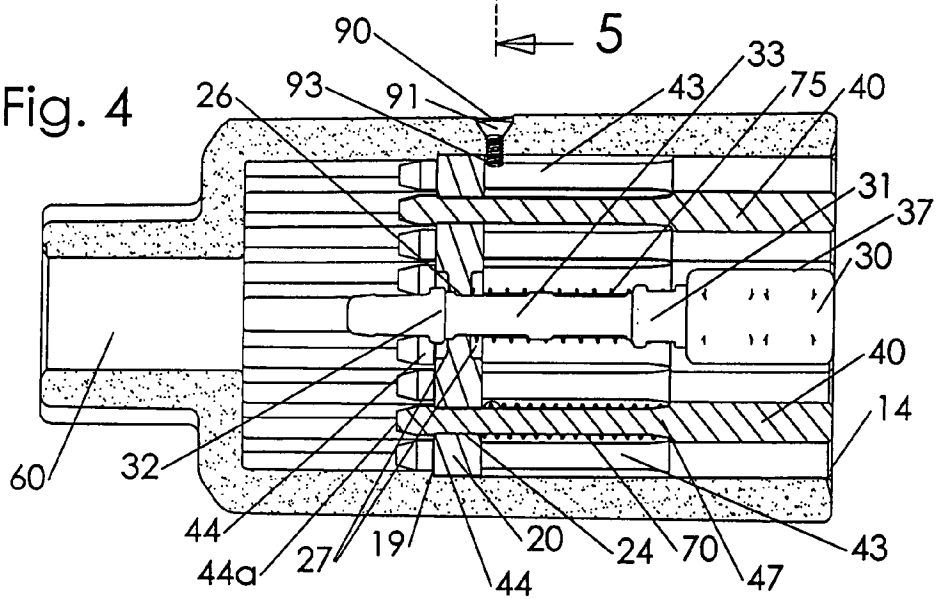
FIG. 4 is a partial sectional view of the socket of FIG. 3, taken along a length of the socket.

In the cross-sectional view of FIG. 4 some internal parts of the socket are revealed. Housing 10 has an open end 14 exposing a plurality of pins 40 packed or bundled in parallel. Preferably at the center of the packed pins 40 is an optional center pin 30, which is used to reduce the total pin count and to help center the socket on the fastener. Shaft 33 of center pin 30 passes through a respective opening 26 at a central location on the frame 20. Shaft 33 is of a smaller diameter than both of large top end 37 and opening 26. A coiled spring 75 is installed longitudinally on the center pin 30 and biases the top end 37 away from frame 20. Bottom end 32 includes a wide diameter that is larger than the inside diameter of opening 26 of frame 20. Center pin 30 is not specifically required, however. Rather, in an alternative embodiment, the central space of socket 10 could instead be filled with additional pins 40 or left open.

Figure 6:
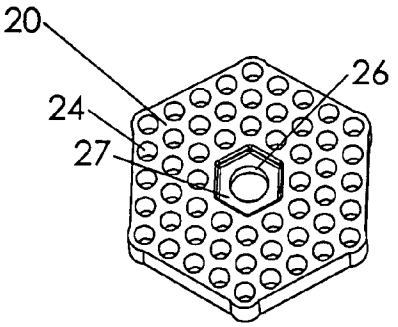
FIG. 6 is a perspective view of the frame.

In a preferred embodiment, frame 20, shown in FIGS. 5 and 6, is made from a deformable material. In the exemplary embodiment shown, frame 20 is made from an elastomeric material, such as polyurethane or other thermoplastic elastomer. This material has a degree of resiliency to improve the action of the pins 40 relative to the frame 20, and assembly and/or disassembly of pins 40 with their enlarged tips 44 through frame openings 24. Frame 20 may also be made from a metal such as iron, stainless steel, etc. that may have been heat treated to impart some further resilience. In other contemplated embodiments, frame 20 may be made from a composite of several metallic-, polymeric-, ceramic-, or cellulose-based materials, or made from slabs of the same or different materials laminated together.

Figure 17A:
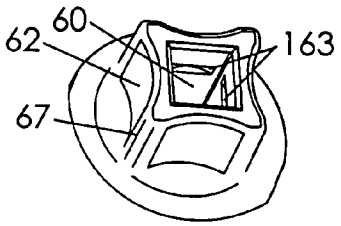
FIG. 17 is a sectional view of a socket with an alternative embodiment adaptor secured to the socket.
Figure 17:
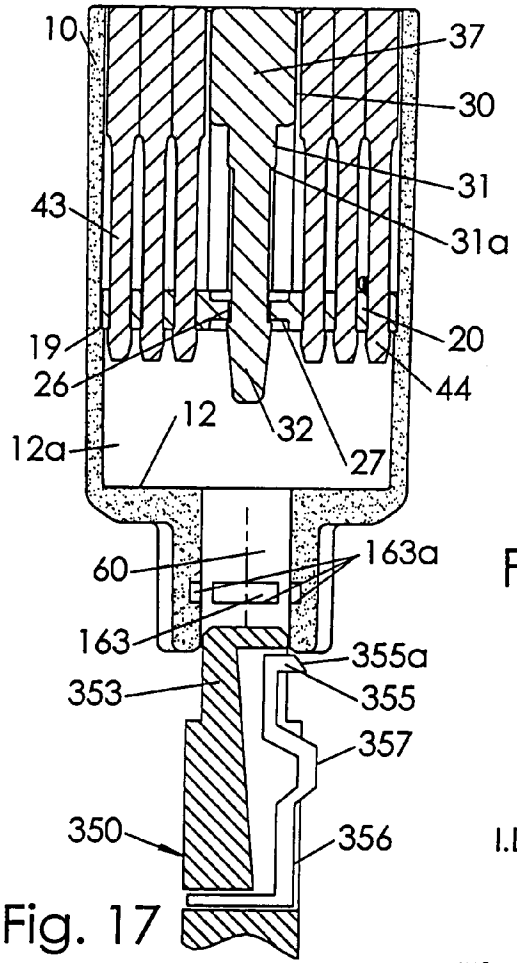

FIGS. 4 and 17 provide a clear view of the interaction between gripping pins 40 and frame 20. Each pin 40 includes shaft 43 onto which coiled spring 70 is coaxially disposed. At the bottom end of each shaft 43 is an enlarged tip 44. Enlarged tip 44 creates an optional interference fit between it and the respective opening 24, seen in FIG. 6, in frame 20. Beneficially, enlarged tip 44 prevents the spring force of coiled spring 70 from detaching pin 40 from frame 20. On the other hand, if necessary, the assembly of pin 40 to frame 20 and the disassembly of pin 40 from frame 20 can be accomplished by a push or tug to pass enlarged tip 44 through opening 24. Enlarged tip 44 includes distal end 44*a*, where the tip tapers smoothly down to the smaller diameter of distal end 44*a*. Distal end 44*a* is substantially smaller in diameter than opening 24 in frame 20. Therefore, it is easy to align pin 40 as it is assembled into frame 20.

In the configuration of FIGS. 4 and 17, pins 40 are assembled into frame 20 by forcing opening 24 to expand as the tapered end of tip 44 passes through opening 24. This is one advantage of a resilient frame 20. This forced-through action may distort opening 24, but due to resilience of the material, opening 24 can somewhat return to its initial size and shape sufficiently to retain pins 40 on plate 24. Also, the resilience in frame 20 adds some compliance to the system reducing likelihood of brittle failure in the frame.

In FIGS. 11 to 13, an alternative embodiment pin assembly is shown. Tip, or bottom end, 144 is reduced in diameter from shaft 43. Groove 48 is further reduced in diameter from tip 144. Spring clip 240 is fitted into groove 48 after pin 40 with spring 70 is fitted into frame 20, wherein shaft 43 extends through opening 24 of frame 20. If it is of the proper design, spring clip 240 may be installed from the side of pin 40 where the inner diameter of groove 48 forces spring clip 240 to spread apart into a strained condition. Or spring clip 240 may be installed axially over tip 144, with the narrowed, tapered distal end 145 of tip 144 causing the spring clip to spread apart. Axial installation allows for a wide variety of spring clip designs. In the case of a clip that is installed axially, reduced diameter tip 144 allows a smaller diameter spring clip 240, in comparison to that which would be required if tip 144 were of the same diameter as shaft 43. The smaller clip fits into the sub-assembly even as the pins are closely packed. If tip 144 were not of reduced diameter, spring clip would be unable to spread apart undamaged if it were small enough to fit in the sub-assembly and were forced to fit over the full diameter shaft 43. When spring clip 240 is within groove 48, the clip returns to a less strained condition. In this embodiment, frame 20 is optionally not made from a resilient material since opening 24 need not expand to fit the pin assembly.

Using a spring clip to retain pins 40 in frame 20 is an improvement over the prior art where a collar or other element of a two-piece pin assembly is pressed or screwed into position. For example, U.S. Pat. No. 5,937,715 to Lin shows a two-piece pin fitted together by screw threads 42 and 32. Assembly by screw action is not practical since each pin must be clamped and held from turning as the retaining element is screwed on. In fact, it is known that a commercial version of '715 patent used press fitting rather than the disclosed screw fitting. U.S. Pat. No. 5,806,385 to Schupp shows a collar 44 that must be pressed, glued or otherwise permanently fitted to smooth shaft 38. A press fitted pin assembly is not suited for removal of a pin for repair by end users. It would require cumbersome tools to grasp and pull apart such an assembly. Notably, disassembly and reassembly of a one-piece pin with enlarged tip 44 such as disclosed above is more convenient than for a two-piece press fitted pin since the one-piece pin may be pulled out without removing frame 20.

With the spring clip embodiment of the present invention, combined with tapered distal end 145, assembly of the pins to frame 20 is efficient since the clips may be pressed on axially. This is especially suited for automated assembly methods where a pick-and-place axial motion is typical. The two-piece press fitted type pins may also be assembled axially. However using clip 240 of the present invention allows an end user to easily disassemble the pin from frame 20, in contrast with the press fitted pin. After the pin/frame subassembly is removed from body 10, spring clip 240 is removed from pin 40. Pin 40 is then withdrawn from frame 20. This process can be done with ordinary tools. Spring clip 240 is well suited for a large size socket tool since such a clip will be of a practically large size for handling during installation or removal of pins.

The spring clips may be of various designs. For example a cylindrical sleeve with a slotted cut, including a "C" shaped cross section, could fit into an axially elongated groove 48.

Figure 9:
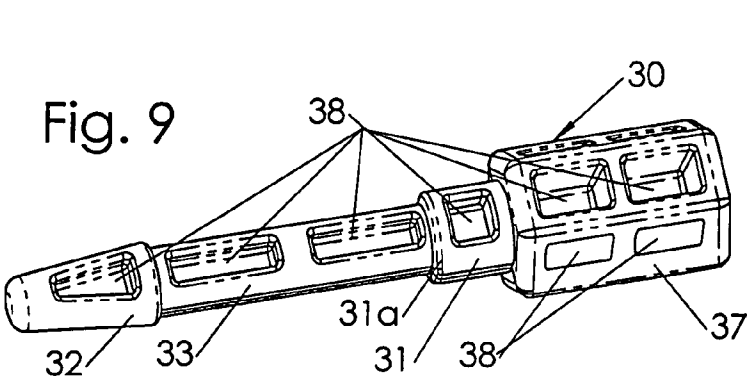
FIG. 9 is a perspective view of the center pin.
Figure 8:
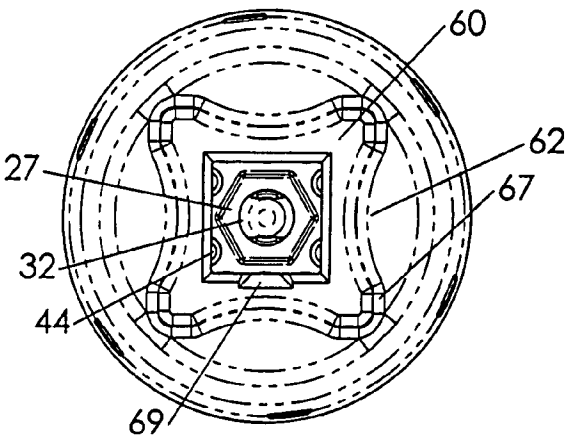
FIG. 8 is a rear end view of the socket.
Figure 16:
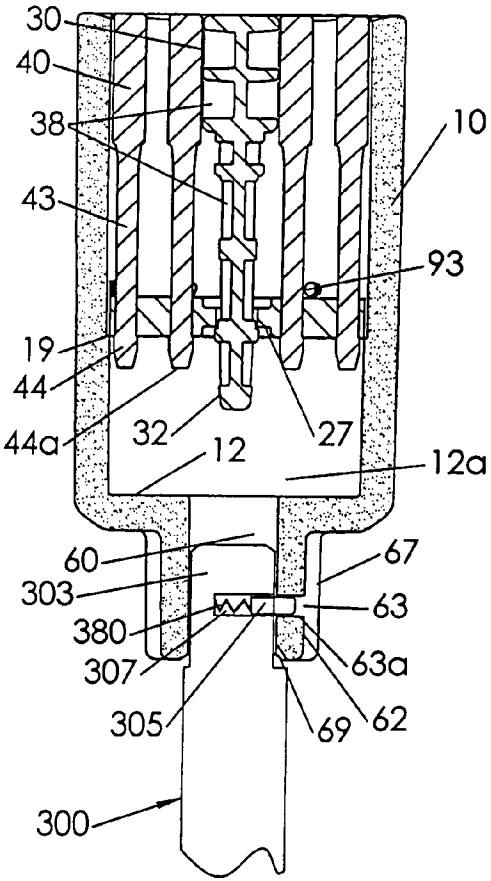
FIG. 16 is a sectional view of a socket with an adaptor secured to the socket square end.

In FIG. 9 center pin 30 is shown in a perspective view. Use of the optional center pin 30 economizes on the total number of pins 40 needed for each socket, thereby minimizing manufacturing and assembly costs. Moreover, center pin 30 helps guide the user in quickly aligning the socket onto a fastener. In the preferred embodiment, center pin 30 is made from an elastomer for toughness. Recesses 38 extend radially into pin 30. In FIG. 16, recesses 38 extend from two sides, although they could extend from one side only, toward the other side. In a large universal socket tool, the center pin would preferably be one inch in effective diameter based on the expected loads and dimensions involved.

With recesses 38 it is practical to produce center pin 30 by molding or die casting since the center pin will comprise a structure made from thin wall sections rather than a mix of thin and thick sections. This is best seen in FIG. 16. However, if the recesses were to extend axially, center pin 30 would be difficult to manufacture. Further, an axially oriented recess that is exposed from the top of the pin would accumulate dirt and be unsightly. With side facing recesses the center pin has only solid looking faces exposed to a user.

Center pin 30 includes intermediate portion 31 at an upper portion of the shaft, with shoulder 31*a*, as seen in FIGS. 9, 14 and 15. Shoulder 31*a* is a transition between shaft 33 and intermediate portion 31. Shoulder 31*a* provides a stop, FIG. 15, so that spring 75 will not be crushed. Shoulder 31*a* presses the face of frame 20, in recess 27 of the face in the illustrated embodiment. By limiting the retraction of center pin 30, springs 70 of the gripping pins 40 are also protected since any object that is pressed into the socket will press center pin 30. The insertion distance into housing 10 of any object is thus limited by shoulder 31*a*.

Recess 27 surrounds opening 26 in frame 20. This recess is required for efficient molding of frame 20 since the material around opening 26 would otherwise be very thick. Optionally ribs may cross recess 27 to add reinforcement if desired. Recess 27 also provides more axial space as spring 75 extends into recess 27, so that spring 75 can be longer and more resilient. A longer spring provides less strain for a given displacement, so the force from the spring is more constant, and/or the spring will be more durable. A more constant force means the spring can more reliably hold the pins in a most extended position while minimizing the force in the most retracted pin position. Optionally a similar recess could surround each opening 24 for pins 40 in frame 20. Then there is similarly more axial space for spring 70.

Housing 10 includes optional inward-protruding shelf 19, shown in FIGS. 4 and 10. The shelf may also be in the form of a ledge, groove, notch, bulge, platform, cantilevered arm, pin or projection, and any number or combinations thereof. The shelf thus limits the inward axial position of frame 20 in housing 10. In various alternative embodiments, the shelf may be replaced by a weld, braze, solder, or adhesive bead. Hold elements 90 limit the outward movement of frame 20, to the right in FIG. 4, with the hold elements 90 preferably being tangent to the right side face of frame 20 in FIG. 4 when frame 20 is urged to move to the right in FIG. 4. As discussed above, hold elements 90 should ideally be positioned so that the body or distal end of the hold element does not press any of pins 40 at shafts 43.

Hold elements 90 should also overlap frame 20 as much as possible for best holding function. A solid holding function is desirable for industrial, heavy duty applications where loads on pins 40, frame 20 and other structures are great and the size of the bolt head, valve stem, etc. is very large. Therefore, it is preferable to keep the distal ends of hold elements 90 an accurate but minimal distance from shafts 43. This distance is shown at the circled area 93 in FIG. 5. For this purpose holes 13, FIGS. 5 and 7, include stop surface 15. Hole 13 is aligned with a central position between two pin shafts 43, and openings 24. Countersunk stop surface 15 is a predetermined distance from the nearest pin shaft and opening 24. In addition, hold element 90 extends to the distal end a predetermined length past flange 91 at a head end. Flange 91 engages stop surface 15 so that hold element 90 cannot inadvertently advance inward past a predetermined position. Flange 91 and stop 15 may be angled as shown, or be perpendicular to the elongated direction of hold element 90. With this positioning structure, the distance between the distal end of hold element 90 and shaft 43 represented at 93 can be accurately maintained so that hold element 90 does not press shaft 43, while still overlapping frame 20 to the maximum extent possible. Hold elements 90 may be threaded or pressed in; hold elements 90 may also be headed or headless fasteners, dowels, roll pins, set screws, machine screws, or the like. Screws have the advantage that they can be easily retracted to facilitate removal of the subassembly including frame 20 and the pins. If shelf 19 is not provided then there may be hold elements 90 below frame 20 as well, located to the left side of frame 20 in FIG. 4. In sum, the presence of hold elements 90 improves the durability and strength of the present invention socket tool for large-sized, heavy duty applications.

In various exemplary embodiments, hold elements 90 have a longitudinal axis aligned not at the center or focus of the socket housing 10 but just slightly off-center. That is, from the plan view of FIG. 5, if theoretical lines were drawn through the longitudinal axis of each hold element 90, those lines would not pass through the center of the socket tool, but would pass adjacent thereto. This radially, off-centered alignment of hold elements 90 help brace frame 20 within housing 10 and better resist any torque encountered by pins 40 that is passed back to frame 20. The radially, off-centered alignment means that the torque transferred from frame 20 to hold elements 90 is received in hold element 90 as a compression force rather than a shear force thus minimizing a potential shear failure in the component.

Furthermore, as best seen in FIG. 5, hold elements 90 are optionally located circumferentially off-centered relative to the regular, symmetrical polygonal shape of frame 20. This circumferentially off-centered placement further help hold elements 90 resists any torque translated into frame and diminishes the possibility of frame 20 distorting under extreme loads. Of course, the bundling effect of the pins collectively and their interaction with the inner walls of the housing clearly provide great torque applying strength to the socket tool.

In the present invention socket, housing 10 is preferably very large. It may weigh 5 to 10 lbs. when made from metal. It is important that it be held securely to a driving implement, such as an adaptor extension. This is particularly important when used for turning municipal water valve heads, gas main valves, sewage pipe fittings or valves, water hydrants, etc. The socket is typically held downward, within a deep hole below pavement or ground level. If the socket falls off the end of the adaptor, it would need to be extracted from the deep hole underground. In FIGS. 16 and 17, structures are shown that hold the socket to an adaptor until a secondary operation is performed.

In FIG. 16, adaptor 300 includes detent bar 305 slidably traversing within elongated cavity 307 such that the bar moves radially in and out of male square end 303 of the adaptor. Adaptor 300 is assembled to the socket by fitting adaptor male square end 303 into housing female square end 60. Ramp 69 provides an external inward force to detent bar 305 as adaptor 300 is inserted into square end 60. Spring 380 biases detent bar 305 outward from cavity 307 to a rest position as shown. Lower wall 63*a* of detent hole 63 is oriented perpendicular to the cylindrical axis of housing 10. As adaptor 300 is pulled away from the socket, downward in FIG. 16, detent hole 63 provides only a shear force, vertical in FIG. 16, to detent bar 305 through perpendicular wall 63*a*. Detent bar 305 is not forced to retract into cavity 307 by the external force from housing 10. A secondary force or action is required to retract detent bar 305 radially into male square end 303, specifically a small elongated implement is used to push detent bar 307 inward so that detent bar 305 disengages hole 63 and lower wall 63*a* whereby the adaptor then moves freely out of square end 60.

FIG. 17 shows another structure that requires a secondary operation to separate the socket from an adaptor. Adaptor 350 is adjacent to but disengaged from the socket. Adaptor 350 includes male square end 353. A latch includes a resilient arm 356 and an engaging end 355 fitted to adaptor 350. Engaging end 355 moves similarly to detent bar 305. An inner notch 163 in square end 60 includes a lower wall 163*a* that is perpendicular to the cylindrical axis of housing 10. Notch 163 may be in one or more of the four walls of square end 60. As adaptor 350 is inserted into square end 60 resilient arm 356 is deflected inward by angled distal end face 355*a* of engaging end 355. As with the detent bar of FIG. 16, when adaptor 350 and the socket are assembled, an external force is required to disengage the adaptor, since perpendicular lower wall 163*a* provides only shear force, vertical in FIG. 17, to engaging end 355. Button 357 is pressed to retract detent 355. In FIGS. 16 and 17, hole 63 and notch 163 comprise cavities into the walls of square end 60. Walls 63*a* and 163*a* comprise radially extending surfaces of these cavities facing upward in an axial direction toward enclosed space 12*a*. A primary axial force oriented to separate the adaptor from the socket will cause no radial motion upon either detent bar 305, or equivalently, engaging end 355.

Figure 18:
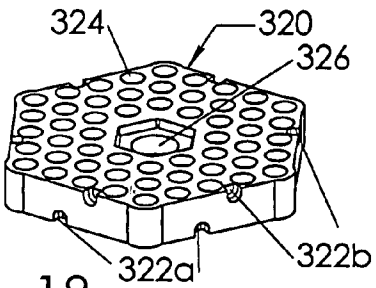
FIG. 18 is a perspective view of an alternative embodiment frame.

In FIG. 18, an alternative embodiment frame 320 is shown. Center pin opening 326 and pin hole 324 correspond to their function in frame 20, FIG. 6. Hold elements 90 would extend into the edge of frame 20 rather than tangent to one or both side faces. Notches 322*a* are shown in the lower edge, with opposed notches 322*b* in the upper edge. Hold elements extending into lower notches 322*a* would hold frame 320 from moving downward in a housing 10, with upper notches holding from upward motion. If shelf 19 is present under frame 20, then only the upper notches would be required, although the opposed notches make the frame symmetric with respect to installation whether or not all the notches are used. With the design of FIG. 18, there are only three hold elements for each direction of the frame. It may in fact be adequate to use just two opposed such elements, for example with only two holes 13 radially opposed in housing 10. Optionally, the hold elements could extend into circular cavities in the edges of frame 320. However, this design would require complicated mold slides or secondary machining. With axially extending notches 322*a*, 322*b* being open toward respective faces of frame 320, the frame can be easily molded without side acting slides.

Naturally, the interior of housing 10 can be of other than hexagonal shape. It is contemplated that the interior of housing may be formed in various polygonal configurations such as pentagons, octagons, square, etc.

It is understood that various changes and modifications of the preferred embodiments described above are apparent to those skilled in the art. Such changes and modifications can be made without departing from the spirit and scope of the present invention. It is therefore intended that such changes and modifications be covered by the following claims.

I claim:

1. A self-forming socket comprising:

a plurality of pins closely packed in parallel, each pin including at least a large top end and a narrow shaft under the top end;

a biasing member disposed on each pin below the top end;

a housing having an interior wall partially enclosing the biasing members and pins, wherein the top ends of the pins are exposed, and with each pin of an outermost ring of pins being immediately proximate to an adjacent pin and to the interior wall;

a frame is positioned within the interior wall and includes a plurality of holes to receive the shafts;

the pins slidable along the shafts within the holes;

the frame is positioned axially within the housing by elongated hold elements, the hold elements extending inward within holes in an exterior of the housing, the holes being circumferentially aligned on the housing relative to the interior walls, whereby the hold element extends inward toward a central position between two adjacent pin shafts of the outermost ring of pins; and wherein at least one of the hold element extends inward from a head end to a distal end, and the hole includes a stop, the head end includes a flange that engages the stop at a predetermined inward position of the hold element, the distal end of the hold element being a predetermined distance from at least one of the adjacent pin shafts in the predetermined inward position of the hold element.

2. The self-forming socket of claim 1, wherein the interior wall of the housing includes a shelf, the frame is positioned above the shelf, and the frame is positioned below at least two hold elements.

3. The self-forming socket of claim 1, wherein the hold elements are in tangential contact with a face of the frame when the frame is urged to move toward the hold elements.

4. The self-forming socket of claim 1, wherein the hold elements extend into edges of the frame.

5. The self-forming socket of claim 4, wherein notches extend into the edges of the frame, the notches are open in a first axial direction toward a face of the frame, the distal end of the hold elements extend into the notches, and the hold elements limit the frame from moving in the first axial direction.

6. The self-forming socket of claim 1, wherein the pins include an enlarged tip at a bottom end of the pin, the frame is of a resilient material, and the bottom end is forcibly slidable through the openings by deformation of the resilient frame material.

7. The self-forming socket of claim 1, wherein slots are formed into the exterior of the housing, and the circumferential alignment of the holes is correlated to a circumferential alignment of the slots.

8. A self-forming socket comprising:

a plurality of pins closely packed in parallel, each pin including at least a large top end and a narrow shaft under the top end;

a biasing member disposed on each pin below the top end;

a housing having an interior wall partially enclosing the biasing members and pins, wherein the top ends of the pins are exposed, and with each pin of an outermost ring of pins being immediately proximate to the interior wall;

a frame is positioned within the interior wall and includes a plurality of holes to receive the shafts;

the pins slidable along the shafts within the holes;

the frame is positioned axially within the housing by elongated hold elements, the hold elements extending inward within holes in an exterior of the housing, the holes being circumferentially aligned on the housing relative to the interior walls, the hold elements extending inward from a head end to a distal end, and the hole includes a stop, the head end includes a flange that engages the stop at a predetermined inward position of the hold element, the distal end of the hold element being a predetermined distance from at least one of the pin shafts in the predetermined inward position of the hold element.

9. The self-forming socket of claim 8, wherein the hold elements extend inward toward a central position between two adjacent pin shafts of the outermost ring of pins.

10. The self-forming socket of claim 8, wherein the hold elements extend into edges of the frame.

11. The self-forming socket of claim 10, wherein notches extend into the edges of the frame, the notches are open in a first axial direction toward a face of the frame, the distal end of the hold elements extend into the notches, and the hold elements limit the frame from moving in the first axial direction.

12. The self-forming socket of claim 8, wherein the pins include an enlarged tip at a bottom end of the pin, the frame is of a resilient material, and the bottom end is forcibly slidable through the openings by deformation of the resilient frame material.

13. A self-forming socket comprising:

a plurality of pins closely packed in parallel, each pin including at least a large top end and a narrow shaft under the top end;

a biasing member disposed on each pin below the top end;

a housing having an interior wall partially enclosing the biasing members and pins, wherein the top ends of the pins are exposed;

a frame is positioned within the interior wall and includes a plurality of holes to receive the shafts;

the pins slidable along the shafts within the holes;

a center pin including a large top end, and a bottom end, and a shaft between the respective top and bottom ends, the shaft extending through a central opening of the frame, the shaft being smaller in diameter than a diameter of the central opening;

the center pin including an intermediate portion of a diameter larger than the diameter of the central opening, the intermediate portion being below the large top end at an upper portion of the shaft, a shoulder at a bottom of the intermediate portion forming a transition between the shaft and the intermediate portion, the shoulder pressing a face of the frame when the center pin is at a predetermined lowest position.

14. The self-forming socket of claim 13, wherein a recessed portion of the frame surrounds at least one of: the central opening, and at least one hole in the frame for one of the pin shafts.

* * * * *

UNITED STATES PATENT AND TRADEMARK OFFICE

CERTIFICATE OF CORRECTION

PATENT NO. : 6,928,906 B1
DATED : August 16, 2005
INVENTOR(S) : Joel S. Marks

It is certified that error appears in the above-identified patent and that said Letters Patent is hereby corrected as shown below:

Title page,
Item [75], Inventor, add -- Stephen Quick, Dorset (UK) --.

Column 4,
Line 33, after "secured to the socket", insert -- Fig. 17A is a rear perspective detail view of a socket square end. --.

Signed and Sealed this

Fourteenth Day of February, 2006

JON W. DUDAS
*Director of the United States Patent and Trademark Office*